United States Patent [19]

Tsutsumi et al.

[11] Patent Number: 4,625,797

[45] Date of Patent: Dec. 2, 1986

[54] CHEMICAL INJECTION TUBE MOUNTING STRUCTURE FOR A GEOTHERMAL WELL

[75] Inventors: Jiro Tsutsumi, Iwate; Minolu Uchiyama, Morioka; Kunio Katagiri, Funabashi, all of Japan

[73] Assignee: Japan Metals and Chemicals Co., Ltd., Tokyo, Japan

[21] Appl. No.: 706,132

[22] Filed: Feb. 27, 1985

[30] Foreign Application Priority Data

Apr. 17, 1984 [JP] Japan ..... 59-76891

[51] Int. Cl.[4] ..... E21B 37/06

[52] U.S. Cl. ..... 166/90; 166/304; 166/312

[58] Field of Search ..... 166/67, 75.1, 90, 304, 166/305.1, 312

[56] References Cited

U.S. PATENT DOCUMENTS 3,830,304 8/1974 Cummins ..... 166/90
4,169,504 10/1979 Scott ..... 166/90
4,214,628 7/1980 Botts ..... 166/75.1
4,393,927 7/1983 Singer ..... 166/305.1
4,431,057 2/1984 Colonna et al. ..... 166/67

*Primary Examiner*—Stephen J. Novosad
*Assistant Examiner*—William P. Neuder
*Attorney, Agent, or Firm*—Parkhurst & Oliff

[57] ABSTRACT

A mounting structure for a chemical injection tube for geothermal wells utilized for power generation from geothermal energy. A chemical injection tube is extended into a geothermal well, having an upper end fastened by a sealing flange and a lower end extending down below the flashing point in the well, wherein scale inhibiting chemicals can be supplied from the ground and injected through the tube directly to the geothermal fluid in the well. Thus, the chemical injection tube facilitates the prevention of carbonate scale deposition in the well and results in a stable power plant operation.

6 Claims, 7 Drawing Figures

CHEMICAL INJECTION TUBE MOUNTING STRUCTURE FOR A GEOTHERMAL WELL

BACKGROUND OF THE INVENTION

The present invention relates to a mounting structure for a chemical injection tube for geothermal wells utilized for power generation from geothermal energy and especially dominated by hot water with steam.

A considerable amount of alkaline earth metals are dissolved in geothermal fluids under high temperature and high pressure subterranean conditions. When the fluid flows up the well such alkaline metals tend to deposit onto the wall surface of the well as carbonates, which then become scale.

The scale causes insufficient fluid production due to its plugging effect and, in an extreme case, complete closing of the well may occur.

Furthermore, there would be a chance for hot water to contain salt deposits already in deep subsurface formations, depending upon the pressure, temperature, ion species and their concentration.

It is heretofore unknown to prevent such carbonates scale adhesion by providing a chemical injection tube in a geothermal well, except that some chemical injection methods are known for hot spring wells. However, the hot spring wells are generally so shallow as compared with geothermal steam wells (hereinafter called "geothermal well"), that liquid chemical injections are only made by manual operation of workers.

However, in the case of a much deeper geothermal well (1000 m or more), chemical injection by manual operation is not only more difficult but also very dangerous due to the blowing of high pressure hot steam.

According to the present invention a chemical injection tube is inserted at the well head into a deep well bore. The upper end the tube is fixed with a sealing flange and at its lower end, extending deeper than the flashing point of the geothermal fluid, the tube is submerged in the fluid.

Scale inhibiting chemicals are added at the upper end and injected directly into the geothermal fluid in the well bore through said tube.

SUMMARY OF THE INVENTION

Accordingly, an object of the present invention is to prevent deposition of carbonate scale in the well, resulting in a stable power plant operation.

Furthermore, on the well head a vertical pipe portion is mounted coaxially with the geothermal well. A sealing flange is placed on the top of said pipe portion and the extended injection tube is supported by said flange, passing through it and extends down deeper than the flashing point.

Oil well specification steel pipe such as tubing pipe and casing liner etc. would be preferable for said injection tube material.

A blow out preventer mounted just below the sealing flange can enhance the safety of the operation.

The injection tube extending into the geothermal well is fixed by retaining bolts in said pipe portion.

Also, a certain number of centralizers are attached at predetermined positions of the tube string to keep it steady on the axis of the well. The retaining bolts and centralizers can also be used for preventing vibration caused by high speed steam pulse flow.

As mentioned above, the lower end of said tube is located below the flashing point of the well. The flashing point herein referred to means the position where boiling of geothermal fluid starts under a pressure reducing condition.

When hot water starts to boil at this flashing point, the alkaline earth metal ions dissolved in the water begin to precipitate to form the carbonate scale.

According to this invention, scale inhibiting chemicals (acrylic acid type, phosphoric acid type, maleic acid type etc.) being injected below said flashing point can prevent deposition of carbonates from the hot water both under and above the ground.

The flashing point varies depending upon the earth crust condition, so that it is difficult to uniformly define. At present it is located in a depth range of about 400–1700 m.

The lower end of said injection tube may be an open hole, but it then becomes possible that geothermal fluid will come into the tube resulting in an injection difficulty and the possibility of the tube plugging due to rust products which may increase after long periods of operation under the corrosive effect of chemicals.

Therefore, it would be desirable that the lower end of the tube be closed, having several tiny holes drilled out at the side wall just above the lower end, while a nozzle is installed downward in the tube. This would prevent invasion by the geothermal fluid and would result in the radial homogeneous injection of chemicals into the well at the same time. The tiny holes can be projected from plugging by rust because the closed bottom of the tube can store a quantity of rust formed in the tube.

Depending upon the pressure, and quantity, it may be possible that geothermal fluid will enter the tube through the tiny holes, so a check valve can be provided in a position above the nozzle on a case by case basis.

The invention, as described above, enables one to inject scale inhibiting chemicals into a geothermal well below the flashing point. For this reason, deposition of carbonate scale from hot water can be avoided effectively both in the well and in the formations thereof. Consequently, by stopping whole scale adhesion even in the pipe line on the ground, stable operation of power plants can be achieved for a long period of time.

The injection tube, according to this invention, can easily be mounted to an existing geothermal well and it can also be mounted to a geothermal well having no self-flashing capability. In the latter case the so called air-lift process can be applied for obtaining steam production. This process consists of introducing compressed air through the pipe string.

It also is possible to construct a double structured tubing system by inserting an air tube in an injection tube. After geothermal fluid flashing is obtained by successful air-lift processing through the inner tube, scale inhibition chemicals are injected advantageously without troublesome tube exchange operation.

According to the present invention, the injection tube has a considerable length, and weighs about 10–20 t. Said vertical pipe portion with said sealing flange must support that weight. To avoid buckling damage of the pipe portion with the seal flange, it would be recommended to use a constant hanger for supporting the pipe portion.

DESCRIPTION OF THE PREFERRED EMBODIMENTS

Figure 1:
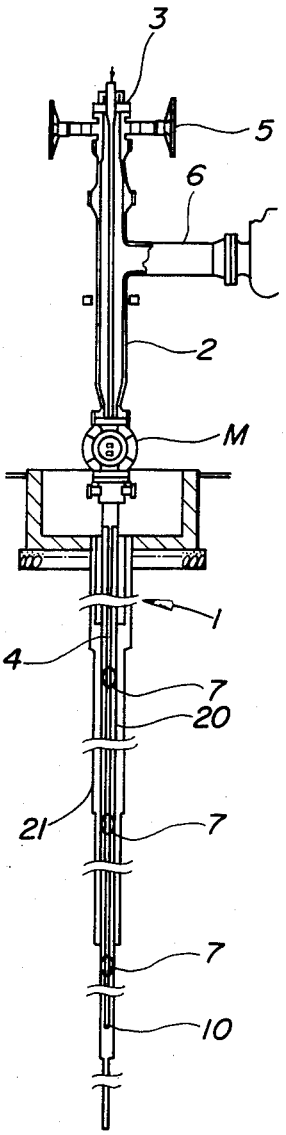
FIG. 1 is a sectional vertical view of a mounting structure for a chemical injection tube, for geothermal wells, of the present invention.

Hereinafter, the present invention will be described further by way of the preferred example.

FIGS. 1 to 4 show a tube assembly constructed in accordance with this invention which will be described with reference to the drawings. A vertical pipe portion 2 is mounted coaxially on a well head of geothermal well 1. The injection tube 4 is fixed by sealing flange 3 on the top of the pipe portion 2, thus enabling the tube 4 to extend deep in the well 1. A blow out preventer 5 is connected with the sealing flange 3. This blow out preventer has the function of protecting the structure from damage due to a blowing out by plugging of the annulus space in the pipe portion 2 with its fitting device catching tube outer surface.

A set of retaining bolts is shown by mark "B" in A main valve M is mounted in the inlet of the geothermal well 1. A horizontal branch (pipe) 6 for producing steam is mounted on the rising pipe 2. The valve M is normally opened, but may be closed for regulating the flow rate.

An inner casing 20 is inserted into the lower portion of the main valve and simultaneously extends down into the geothermal well. An outer casing 21 surrounds the inner casing 20 and also extends down into the well.

Several centralizers 7 are attached to the tube 4 at positions such that tube 4 is always disposed at the center of the geothermal well.

Figure 3:
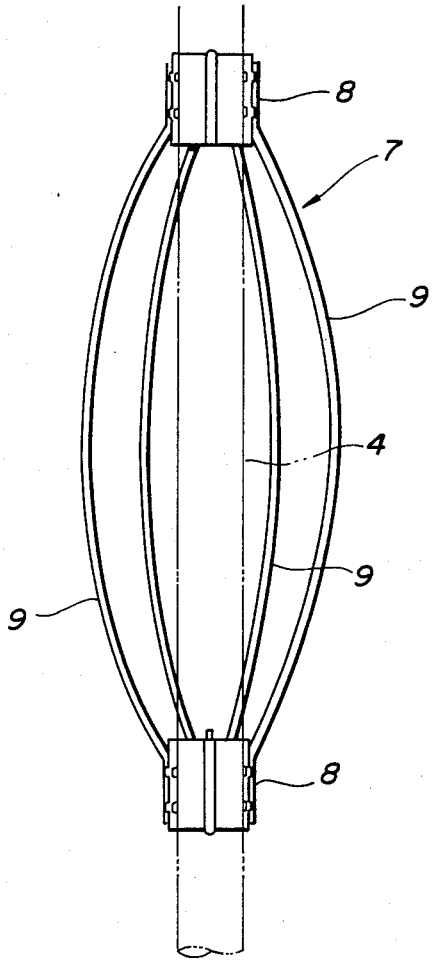
FIG. 3 is a front view of an example of a centralizer used in the invention.
Figure 4:
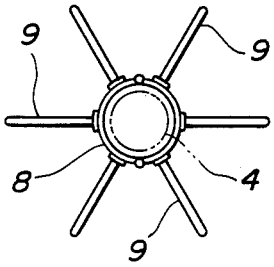
FIG. 4 is a plan view of the of centralizer in FIG. 3.

As shown in FIGS. 3 and 4, centralizers are mounted at a plurality of positions on tube 4 which is extended into the geothermal well, so that tube 4 is always disposed at the center of the geothermal well.

The purpose of the centralizer is to prevent damage to tube 4 due to vibrations caused by the geothermal steam (fluid) flowing at a high speed in the geothermal well.

The centralizer 7 has rings 8 mounted at suitable intervals between upper and lower positions of the tube 4 and coupled by a plurality of rods 9. The rods 9 are bent radially outward from the tube 4, and contact the inner wall of the inner casing pipe of the geothermal well. Thus, the tube is supported at the center of the geothermal well.

Figure 5:
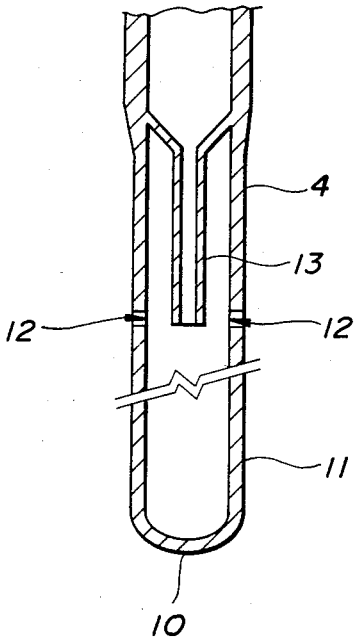
FIG. 5 is an enlarged sectional view of the essential parts of the lower end of the chemical injection tube in the invention.

As shown in FIG. 5, the lower end 10 of the tube 4 is closed and having several tiny holes pierced through the peripheral wall thereof, below a nozzle which is installed downward in the tube. The tiny holes are for supplying fluid into the geothermal well.

To inject scale inhibiting chemicals through the tube 4 as mentioned above, chemicals are filled into a pipe (not shown in the drawing) connected with the sealing flange 3 and are then injected through the tiny holes 12 directly into the well 1.

Furthermore, since injection is always carried out below the flashing point, no scale deposition occurs both in the well bore and in the ground pipe line. Therefore, stabilized power plant operation can be achieved for a long period.

Figure 2:
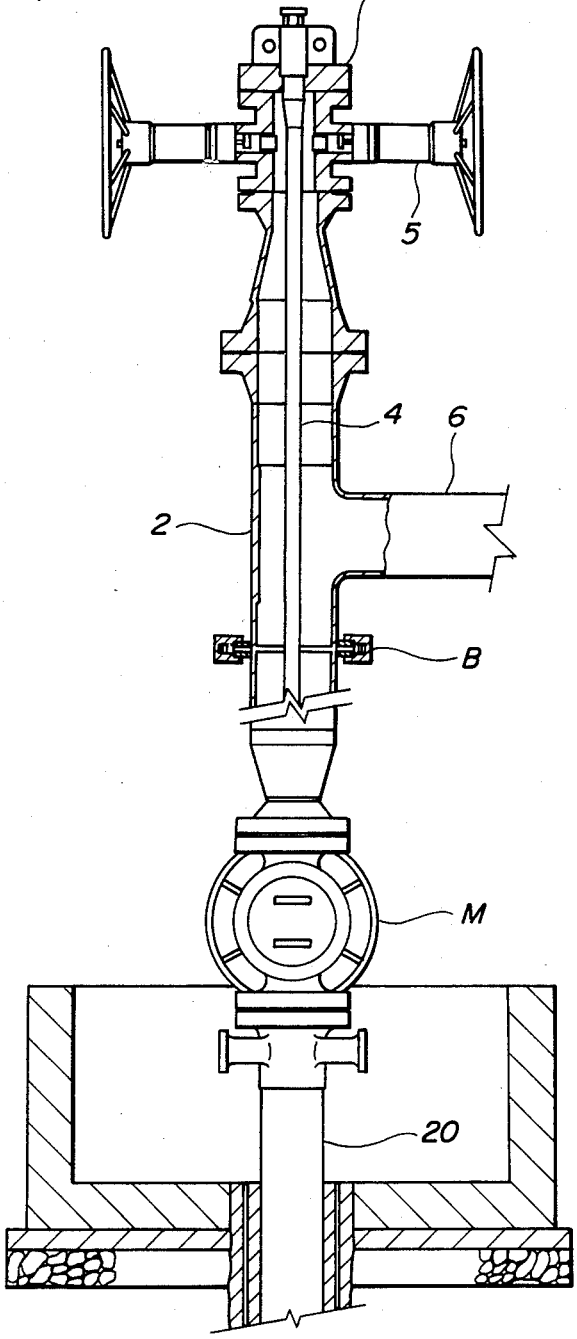
FIG. 2 is an enlarged sectional view of the essential part of the mounting structure of the chemical injection tube in FIG. 1.
Figure 6:
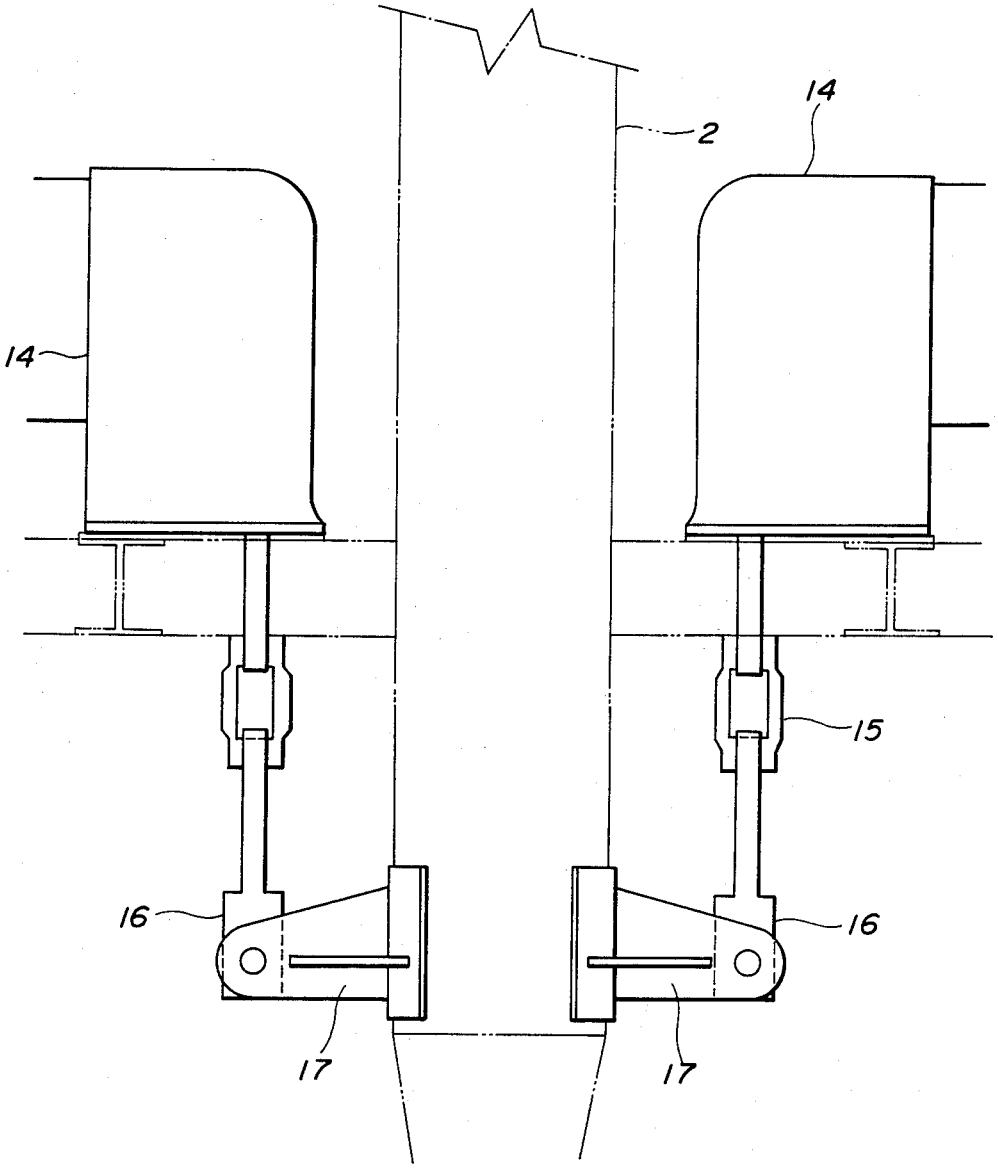
FIG. 6 is a front view of an example of a constant hanger.

Although not shown in FIGS. 1 and 2, a constant hanger 14, as shown in FIG. 6, pinches and supports the pipe portion 2 via turn buckles 15 and clevis bolt 16, so that the weight of the tube 4 is also supported by it to avoid buckling damage of the pipe portion 2.

Figure 7:
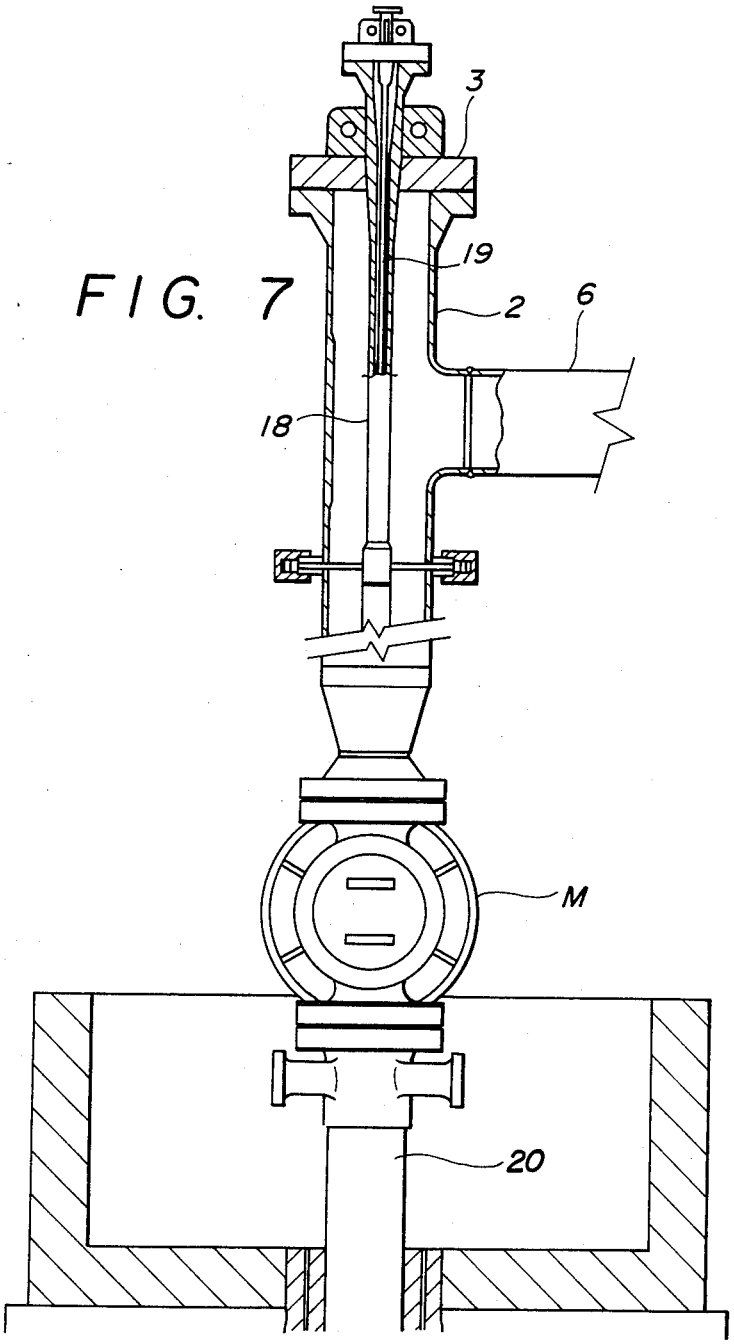
FIG. 7 is a sectional view of the essential part of another example of the chemical injection tube in the invention.

As another embodiment according to this invention, FIG. 7 shows an example in which the same reference numbers are used for the corresponding elements, and in which the injection tube 18 comprises an air-lift pipe 19 inside it. Because there are some depth differences between chemical injection and air lift (generally air is blown out in depth of 100 to 700 m), the lower end of the air lift pipe 19 can be shallower in the well than that of the injection tube 18. An air blow device may be so constructed that air can be blown out through the tube wall 18.

Although the pipe 19 is shown inside of the injection tube 18 in FIG. 7, the present invention is not limited to this embodiment and a reverse arrangement is also possible.

FIG. 7 shows an arrangement without blow out preventer under sealing flange 3.

In the case of a geothermal well having no self-flashing capability, injection tube 18 as shown in FIG. 7 may be advantageously used, as scale inhibiting chemicals can be injected into the well through the tube 18 after carrying out stimulation for well flashing by air the lift process. As the result, no plugging of the well due to scale adhesion will be expected.

What is claimed is:

1. A chemical injection tube mounting structure for a geothermal well having a fluid with a characteristic flashing point, comprising:

a vertical pipe mounted coaxially with a bore hole of a geothermal well;

a sealing flange mounted at the upper end of said vertical pipe;

a chemical injection tube having a lower end, an upper end, an inside wall and a peripheral wall, said tube secured at said upper end to said sealing flange and extending down into said vertical pipe, said tube extending at said lower end down to below the flashing point in the well, and further being enclosed at said lower end thereof;

a nozzle extending downward from said inside wall of said chemical injection tube at a position between said upper end and said lower end, said chemical injection tube pierced by several tiny holes through said peripheral wall, said tiny holes located below said nozzle for supplying scale preventing chemicals, provided from above ground, into the geothermal well.

2. A chemical injection tube mounting structure according to claim 7, further comprising a plurality of centralizers attached to said tube extending down into the geothermal well.

3. A chemical injection tube mounting structure according to claim 7, further comprising a blow out preventer, said blow out preventer mounted on said vertical pipe.

4. A chemical injection tube mounting structure according to claim 7, further comprising a constant hanger, said constant hanger used for supporting said vertical pipe.

5. A chemical injection tube mounting structure according to claim 1, further comprising an air or water supplying pipe for applying pressure to the geothermal well, said pipe inserted inside said chemical injection tube.

6. A chemical injection tube mounting structure according to claim 1, further comprising an air or water supplying pipe for applying pressure to the geothermal well, said pipe coaxially surrounding said chemical injection tube.

* * * * *